United States Patent [19]

Hury

[11] Patent Number: 4,669,526

[45] Date of Patent: Jun. 2, 1987

[54] REMOTELY ADJUSTABLE CONTINUOUS CASTING MOLD

[75] Inventor: Shlomo Hury, Woodcliff Lake, N.J.

[73] Assignee: SMS Concast Inc., Montvale, N.J.

[21] Appl. No.: 746,956

[22] Filed: Jun. 20, 1985

[51] Int. Cl.[4] ..... B22D 11/04; B22D 11/12

[52] U.S. Cl. ..... 164/418; 164/436; 164/441; 164/442

[58] Field of Search ..... 164/441, 442, 484, 418, 164/436, 443, 444

[56] References Cited

U.S. PATENT DOCUMENTS

| | | | |
|---|---|---|---|
| 2,284,503 | 5/1942 | Williams | 164/441 |
| 3,559,719 | 2/1971 | Rossi | 164/442 |
| 3,580,327 | 5/1971 | Khimich et al. | 164/280 |
| 3,753,459 | 8/1973 | Burkhardt et al. | 164/441 |
| 3,930,534 | 1/1976 | Wannenberg et al. | 164/418 |
| 4,015,656 | 4/1977 | Scheinecker et al. | 164/282 |
| 4,136,728 | 1/1979 | Schmid | 164/444 |
| 4,245,692 | 1/1981 | Hargassner et al. | 164/436 |

FOREIGN PATENT DOCUMENTS

| | | | |
|---|---|---|---|
| 102345 | 7/1983 | European Pat. Off. | 164/442 |
| 2445744 | 9/1980 | France | 164/436 |
| 20967 | 6/1976 | Japan | 164/441 |

*Primary Examiner*—Nicholas P. Godici
*Assistant Examiner*—Samuel M. Heinrich
*Attorney, Agent, or Firm*—Peter K. Kontler; Tobias Lewenstein

[57] ABSTRACT

A vertical slab mold has a pair of spaced wide walls, and a pair of spaced narrow walls which are located between the wide walls. The narrow walls are movable towards and away from one another for the purpose of performing width changes during casting. Drives for remote adjustment of the narrow walls during casting are connected with the narrow walls. A support for the narrow face of a slab is mounted immediately below each of the narrow walls and constitutes a downward extension of the respective narrow wall. The upper end of each support is articulated to the bottom of the associated narrow wall so that the support pivots relative to the narrow wall towards and away from the other support. A biasing element acts on the lower end of each support to urge the latter towards the other support and, hence against an adjacent narrow face of a slab. The biasing elements are designed to permit the supports to follow changes in the contours and/or positions of the narrow faces of the slab. This enables the supports to remain in engagement with the narrow faces of the slab even during periods of width change. Since bulging of the narrow faces during a width change is thus inhibited by the supports, it is unnecessary to reduce the casting speed when performing a width change.

17 Claims, 7 Drawing Figures

REMOTELY ADJUSTABLE CONTINUOUS CASTING MOLD

BACKGROUND OF THE INVENTION

The invention relates generally to a continuous casting mold.

More particularly, the invention relates to a remotely adjustable continuous casting mold.

The continuous casting of large strands such as slabs is generally performed in a mold made up of two essentially parallel wide walls and two essentially parallel narrow walls which are located between the wide walls. The walls cooperate to define a casting passage of rectangular cross section.

The slab formed in a continuous casting mold constitutes a semifinished article which is subsequently rolled to produce plate. The width of the plate is a function of the width of the slab.

The production of plate by a mill is usually based on orders received by the mill. Frequently, the order log is such that casting of an entire slab having a single width would result in an excess of plate of a particular width. In such cases, it is desirable to change the width of the slab so as to produce plate of a different width.

Since it is difficult and uneconomical, if not impossible, to interrupt and then restart the casting of a slab in order to provide an opportunity for a width change, a mold which enables a width change to be effected while casting has been developed. This mold, which is known as a remotely adjustable mold, is designed in such a manner that the narrow walls may be moved towards and away from one another without stopping movement of the slab, i.e., without interrupting the casting operation.

The slab has a very thin skin when it initially forms in the mold. In order to avoid rupture of the skin during a width change, the narrow walls must be moved relatively slowly so that they constantly support the narrow faces of the slab. Therefore, it takes a certain amount of time to effect the width change. Since the slab continues moving while the width change takes place, the portion of the slab which passes through the mold during the period required to carry out the width change is tapered.

Due to the initial weakness of its skin, the slab must be supported even after it leaves the mold. To this end, a series of support zones is arranged downstream of the mold. Each support zone includes two essentially parallel wide sides made up of cooling grids, cooling plates or rollers which engage the wide faces of the slab. Each support zone further includes two essentially parallel narrow sides likewise made up of cooling grids, cooling plates or rollers which engage the narrow faces of the slab.

The first support zone following the mold is particularly critical since the skin of the slab has not had a chance to develop significantly and therefore requires substantial support. During normal operation, the four faces of the slab are in contact with the respective sides of the first support zone.

The narrow sides of the first support zone are movable towards and away from one another to allow for changes in the width of the slab. However, it is extremely difficult to synchronize the movements of the narrow sides of the first support zone with those of the narrow walls of the mold. Furthermore, the narrow sides of the first support zone are not designed to be inclined so that they are unable to conform to the taper of the slab during a width change. For these reasons, it is the practice to back the narrow sides of the first support zone away from the slab while a width change is taking place. This leaves the narrow faces of the slab with no support. The result is a bulging of the narrow faces of the slab caused by the pressure of the molten metal constituting the core of the slab. Bulging is undesirable from a quality standpoint and, in addition, increases the risk of a breakout, i.e., rupture of the skin of the slab and an accompanying escape of the molten metal confined by the skin.

The extent of bulging can be decreased by reducing the casting speed. However, this reduces the output of the continuous casting apparatus.

OBJECTS AND SUMMARY OF THE INVENTION

It is an object of the invention to provide an arrangement which enables bulging to be decreased without reducing the casting speed.

The preceding object, as well as others which will become apparent as the description proceeds, are achieved by the invention.

One aspect of the invention resides in a continuous casting mold which comprises the following:

A. A pair of opposed, generally vertical first walls.

B. A pair of opposed, generally vertical second walls disposed between the first walls for movement towards and away from one another. The first and second walls cooperate to define a generally vertical casting passage having open ends.

C. Operating means for remotely adjusting the second walls while casting.

D. A strand support mounted on each second wall for movement relative to, and constituting a downward extension of, the respective second wall.

E. A biasing element for each support urging the same towards the other support. Each of the biasing elements is designed to permit movement of the respective support in automatic response to changes in the contour and/or position of an adjacent strand surface so that the support remains in engagement with the surface.

In a conventional first support zone, the movable sides are under manual control. This leads to the problem outlined earlier, namely, that of synchronizing the movable sides with the adjustable walls of the mold during width adjustment. Moreover, the movable sides of a conventional first support zone cannot be pivoted and thereby inclined so as to conform to the taper of the strand during width adjustment. Consequently, the movable sides would be unable to provide support for the strand even if they could be synchronized with the adjustable walls of the mold.

According to the invention, these problems are overcome by replacing the manually controlled, nonpivotable, movable sides of the first support zone by supports which are mounted on the adjustable mold walls and are movable relative thereto in automatic response to changes in the contour and/or position of an adjacent strand surface. Since each support moves as a unit with the respective adjustable mold wall, it is unnecessary to regulate the movements of the supports so that the latter are synchronized with the mold walls. Furthermore, inasmuch as each support can move relative to the respective mold wall and, in addition, can respond to changes in both the contour and position of the adjacent strand surface, the supports are capable of remaining in engagement with the strand at all times.

The novel features which are considered as characteristic of the invention are set forth in particular in the appended claims. The improved mold, itself, however, both as to its construction and its mode of operation, together with additional features and advantages thereof, will be best understood upon perusal of the following detailed description of certain specific embodiments with reference to the accompanying drawings.

DESCRIPTION OF THE PREFERRED EMBODIMENTS

Figure 1:
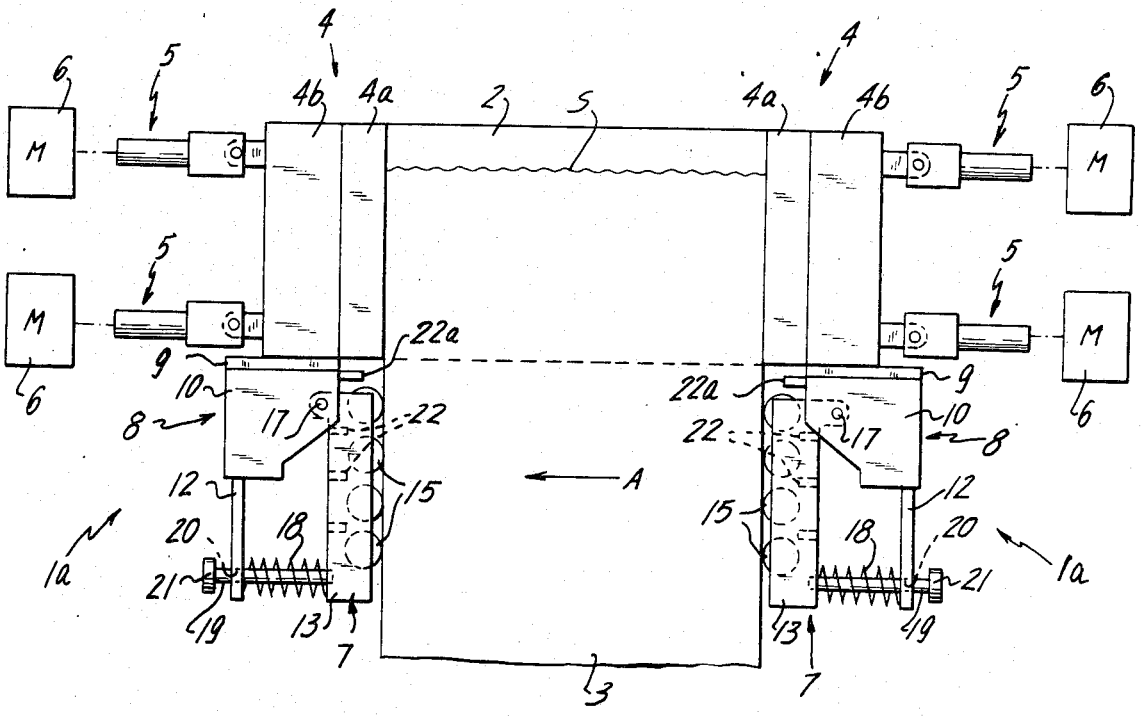
FIG. 1 is a front view of one embodiment of a remotely adjustable continuous casting mold according to the invention with one of the wide walls omitted.

Throughout the drawings, the same reference numerals will be used to identify like elements.

FIG. 1 illustrates a continuous casting mold 1*a* designed for use in a vertical continuous casting apparatus. The mold 1*a*, which is particularly well-suited for the continuous casting of steel, may be of the curved type or the straight type. The mold 1*a* is shown as being a slab mold but the invention is not limited to the casting of strands in the form of slabs.

The mold 1*a* has a pair of opposed, generally vertical wide walls 2 of which only one is illustrated. The wide walls 2, which are entirely conventional, are spaced from one another in a direction normal to the plane of FIG. 1. The wide walls 2 are cooled in a manner known per se so that molten material which is teemed into the mold 1*a* and contacts the wide walls 2 solidifies to form the skin of a continuously cast strand or slab 3.

The mold 1*a* accommodates a bath of molten material during casting, and the upper surface of such bath is identified by the reference character S.

A pair of opposed, generally vertical narrow walls 4 is disposed between the wide walls 2. The narrow walls 4 are conventional, and each of the narrow walls 4 includes a copper plate 4*a* which is cooled in a manner known per se, and a back-up plate 4*b* secured to the respective copper plate 4*a*. The narrow walls 4 and wide walls 2 cooperate to define a generally vertical casting passage having a rectangular cross section. The casting passage is open at both its upper and lower ends, and molten material is teemed into the upper end of the casting passage while the slab 3 is withdrawn from the mold 1*a* via the lower end of the casting passage.

The mold 1*a* is a plate mold of the type which can be adjusted during casting, i.e., without interrupting the introduction of molten material into and withdrawal of the slab 3 from the mold 1*a*, in order to increase or decrease the width of the slab 3. To this end, the narrow walls 4 are movable towards and away from one another. A pair of spindles 5 is mounted on each narrow wall 4, and each spindle 5 is connected with a respective drive or motor 6. The spindles 5 and motors 6 together constitute an operating means which allows the narrow walls 4 to be moved towards and away from one another, and also to be pivoted, while casting proceeds. The operating means 5,6 is designed so that the narrow walls 4 may be adjusted by an operator remote from the mold 1*a*.

The manner of moving the narrow walls 4 towards and away from one another does not constitute part of the invention per se, and any conventional procedure may be used. Similarly, the operating means 5,6 may be of any known design.

Immediately below the mold 1*a* is a nonillustrated support zone. This support zone, which is distinct from the mold 1*a*, resembles and is mounted in the same manner as a conventional first support zone. However, the support zone immediately following the mold 1*a* differs from a conventional first support zone in that it is designed to support only the wide faces of the slab 3. The narrow faces of the slab 3 are, in accordance with the invention, supported by respective strand supports 7 mounted on the mold 1*a*. Each of the strand supports 7 is suspended from the lower end, and constitutes a downward extension, of one of the narrow walls 4.

Figure 2:
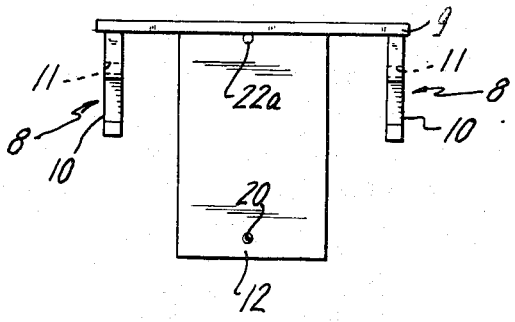
FIG. 2 is a view of a mounting bracket constituting part of the mold of FIG. 1 as seen in the direction of the arrow A of FIG. 1.

A mounting bracket 8 is fixed to the bottom of each narrow wall 4. Referring to FIG. 2 in conjunction with FIG. 1, each mounting bracket 8 comprises a horizontal mounting plate 9 which is secured to the lower end of the respective narrow wall 4 in any suitable manner, e.g., by means of bolts. A pair of spaced bearing plates 10 depends from each mounting plate 9, and each bearing plate 10 is provided with a passage 11. In addition, a reaction plate 12 depends from each of the mounting plates 9. As best seen in FIG. 1, the reaction plates 12 are located to the rear of the passages 11. The plates 9, 10, 12 of each bracket 8 define a rigid unit which, in turn, is fast with the respective narrow wall 4.

Figure 3:
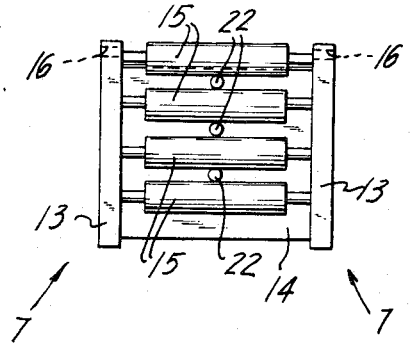
FIG. 3 is a view of a strand support constituting part of the mold of FIG. 1 again as seen in the direction of arrow A.

Each of the strand supports 7 is pivotally mounted on one of the brackets 8 and is thus pivotable relative to the respective narrow wall 4. With reference now to FIGS. 1 and 3, each strand support 7 includes a pair of spaced, generally vertical carrier plates 13 which are joined to one another by a connecting plate 14. A set of rollers 15 is journalled in the carrier plates 13 of each strand support 7. The upper end of each carrier plate 13 is formed with a passage 16. As shown in FIG. 1, the passages 16 are in register with the passages 11 of the brackets 8, and a pivot pin 17 extends through the passages 11,16 thereby pivotally supporting the strand supports 7 on the brackets 8. The strand supports 7 are designed and mounted in such a manner that the rollers 15 engage the narrow faces of the slab 3.

A biasing element in the form of a compression spring 18 is disposed between the connecting plate 14 of each strand support 7 and the reaction plate 12 of the corresponding bracket 8. The compression springs 18, which bear against the connecting plates 14 and the reaction plates 12, function to urge the strand supports 7 towards each other and, hence, to urge the rollers 15 into engagement with the narrow faces of the slab 3. Due to the resilient nature of the compression springs 18, the strand supports 7 are able to follow changes in the contours and/or positions of the adjacent narrow faces of the slab 3 regardless of whether the width of the slab 3 is increased or decreased. The compression springs 18 permit the strand supports 7 to move in automatic response to changes in the contours and/or positions of the narrow faces of the slab 3 so that these faces are supported at all times.

The compression springs 18 are located at or proximate to the lower ends of the respective strand supports 7, and each of the compression springs 18 is preferably situated centrally of the corresponding strand support 7. The compression springs 18 are mounted on the shanks of bolts 19 which are slidable in passages 20 formed in the reaction plates 12 of the brackets 8. Each of the bolts 19 has a head 21 located on that side of the respective reaction plate 12 which is remote from the corresponding strand support 7. The heads 21 are larger than the passages 20 and are thus unable to pass therethrough. The ends of the bolts 19 remote from the heads 21 are secured to the connecting plates 14 of the respective strand supports 7. For example, the ends of the bolts 19 may be threaded into the connecting plates 14.

Spray nozzles 22 for cooling the slab 3 are mounted on the connecting plates 14 of the strand supports 7. Each of the nozzles 22 is arranged to direct a water spray towards the slab 3 through the gap between a pair of neighboring rollers 15. One or more additional spray nozzles **22*a* may be mounted on each of the brackets 8, e.g., at the undersides of the mounting plates 9. The spray nozzles 22*a* are arranged to direct water sprays towards the strand 3 through the gaps between the uppermost rollers 15 and the lower ends of the respective narrow walls 4 of the mold 1*a*. The spray nozzles 22, 22*a*** are connected to a non-illustrated water source such as a header by means of non-illustrated hoses.

Figure 4:
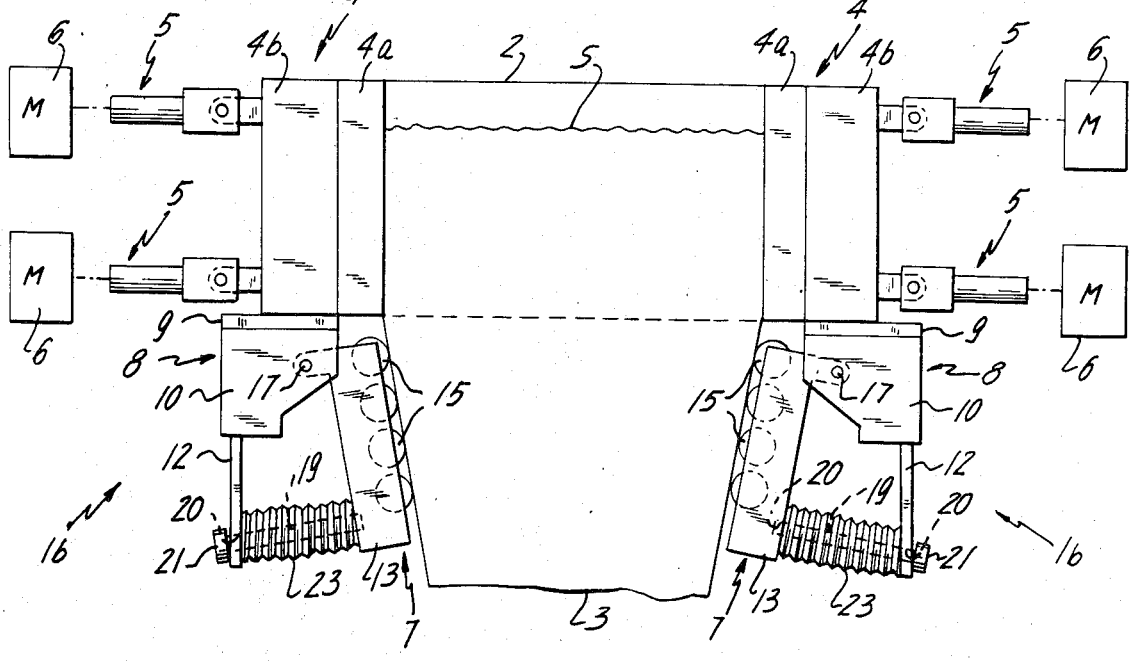
FIG. 4 is similar to FIG. 1 but illustrates another embodiment of a remotely adjustable continuous casting mold in accordance with the invention.

FIG. 4 illustrates a second mold **1*b*. The mold 1*b* differs structurally from the mold 1*a* of FIG. 1 in that the compression springs 18 are replaced by bellows 23. The bellows 23 are mounted on the bolts 19 in such a manner that relative sliding movement of the bolts 19 and the bellows 23 can occur. This may be accomplished by securing a dynamic seal to either end of each bellows 23 and slidably mounting the seals on the respective bolts 19**.

The bellows 23 again serve to urge the rollers 15 of the strand supports 7 into engagement with the narrow faces of the slab 3.

FIG. 1 shows the mold **1*a* in the condition it assumes when the width of the slab 3 is maintained constant during casting. On the other hand, the mold 1*b* of FIG. 4 is illustrated during a decrease in the width of the slab 3**.

Figure 5:
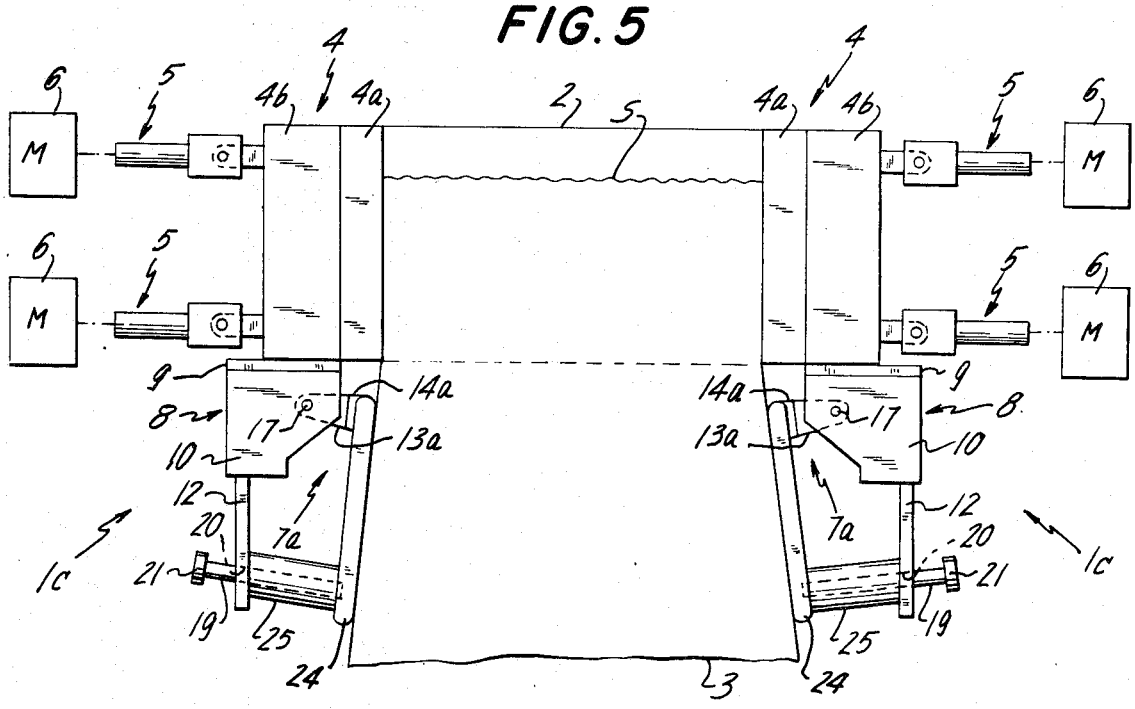
FIG. 5 is similar to FIG. 1 but shows an additional embodiment of a remotely adjustable continuous casting mold according to the invention.

FIG. 5 shows a mold **1*c* in a configuration it assumes while the width of the slab 3 is being increased. The mold 1*c* differs from the mold 1*a* of FIG. 1 in the design of the strand supports and the nature of the means for biasing the strand supports towards the slab 3**.

In FIG. 5, the strand supports are identified by the reference numeral **7*a*. Each of the strand supports 7*a* includes a pair of spaced carrier plates 13*a* which correspond to, but are shorter than, the carrier plates 13 of the strand support 7 illustrated in FIG. 3. Similarly to the carrier plates 13, the carrier plates 13*a* are provided with passages 16 which register with the passages 11 in the brackets 8 and receive the pivot pins 17. The carrier plates 13*a* of each pair are joined to one another by a connecting plate 14*a* disposed at the ends of the respective carrier plates 13*a* remote from the passages 16 and pivot pins 17. Each of the connecting plates 14*a* is secured to the upper end of a generally vertical, conventional cooling plate 24 which constitutes a downward extension of the adjacent narrow wall 4*a* of the mold 1*c*. The strand supports 7*a* are designed and mounted in such a manner that the cooling plates 24 contact the narrow faces of the slab 3**.

Each of the cooling plates 24 is urged towards the slab 3 by a biasing element in the form of an elastomeric or rubber sleeve 25. The sleeves 25 are located at or proximate to the lower ends of the cooling plates 24 and bear against the latter as well as against the reaction plates 12 of the respective brackets 8. The sleeves 25 are mounted on the bolts 19 which are here fast with the cooling plates 24. The bolts 19 and the sleeves 25 need to be slidable relative to one another and, if necessary, a lubricant may be provided between the outer surfaces of the bolts 19 and the inner surfaces of the sleeves 25.

Figure 6:
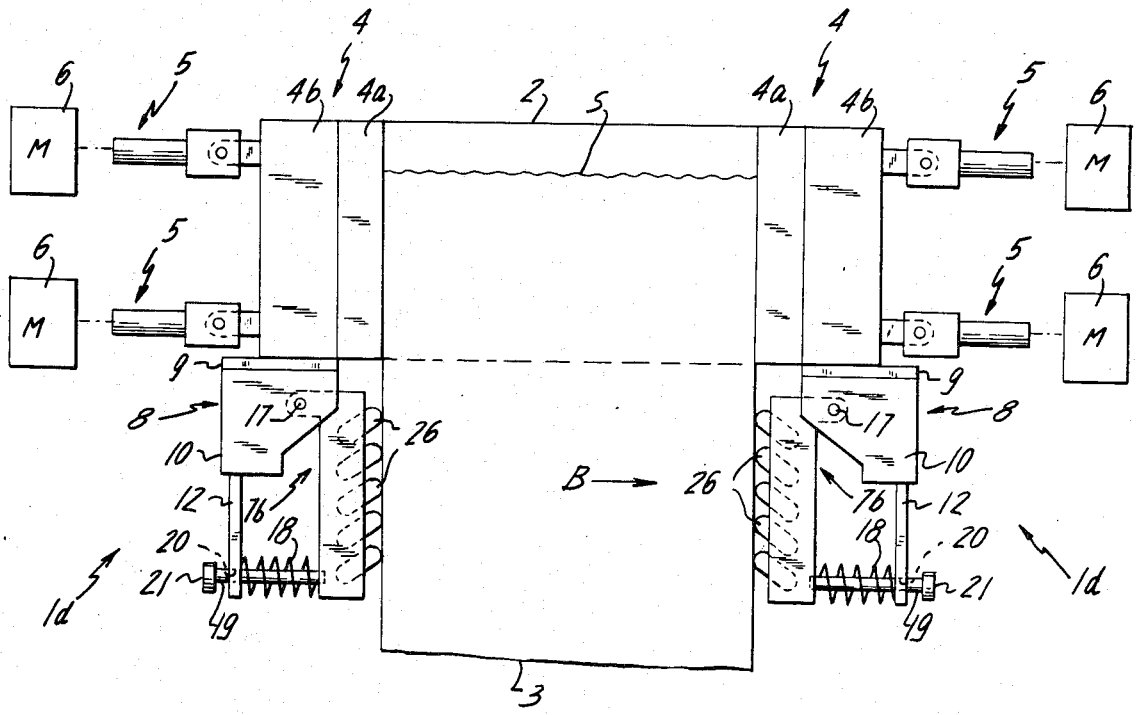
FIG. 6 is similar to FIG. 1 but illustrates a further embodiment of a remotely adjustable continuous casting mold according to the invention.
Figure 7:
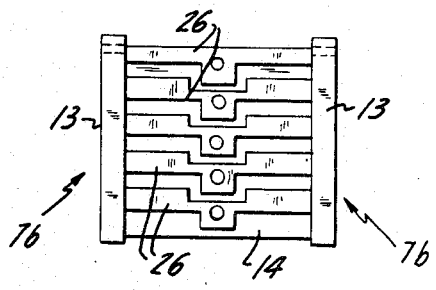
FIG. 7 is a view of a mounting bracket and strand support as seen in the direction of the arrow B of FIG. 6.

FIGS. 6 and 7 illustrate a mold **1*d* which differs from the mold 1*a* of FIG. 1 in that each strand support 7 is replaced by a strand support 7*b* having a set of conventional cooling grids 26 instead of the rollers 15. The cooling grids 26 are supported by the carrier plates 13 of the support 7*b***.

It will be understood that the compression springs 18 of FIGS. 1 and 6 may be used in conjunction with the cooling plates 24 of FIG. 5; that the bellows 23 of FIG. 4 may be used in conjunction with the cooling plates 24 of FIG. 5 as well as the cooling grids 26 of FIG. 6; and that the resilient sleeve 25 of FIG. 5 may be used in conjunction with the rollers 15 of FIGS. 1 and 4 or the cooling grids of FIG. 6.

The molds **1*a*–1*d* of the invention make it possible to support the narrow faces of the slab 3 at all times. This is due to the fact that the strand supports 7,7*a*,7*b* are urged towards the narrow faces by biasing elements 18,23,25 which permit the strand supports 7,7*a*,7*b* to move in correspondence to changes in the contours and/or positions of the narrow faces. Since the strand supports 7,7*a*,7*b* are able to follow changes in the contours and/or positions of the narrow faces of the slab 3**, bulging of the narrow faces during a width change is inhibited. This, in turn, makes it possible to perform a width change without reducing the casting speed.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A continuous casting mold operable to increase and decrease the dimensions of a strand while casting, said mold comprising:

(a) a pair of opposed, generally vertical first walls;

(b) a pair of opposed, generally vertical second walls disposed between said first walls for movement towards and away from one another, said first and second walls cooperating to define a generally vertical casting passage having open ends;

(c) Operating means for remotely adjusting said second walls while casting;

(d) a strand support mounted on each second wall for movement relative to, and constituting a downward extension of, the respective second wall, each of said supports being movable relative to the respective second wall in such a manner as to be capable of adjusting to changes in the contour of an adjacent strand surface; and (e) a pivotable biasing element for each support urging the same towards the other support, each of said supports being free to pivotally move under the action of the respective biasing element in automatic response to changes in the contour of an adjacent strand surface during both an increase and a decrease in strand dimensions so that the support remains in engagement with the surface.

2. The mold of claim 1, wherein each support is pivotally mounted on the respective second wall.

3. The mold of claim 2, each of said supports having an upper end and a lower end; and wherein each support is articulated to the respective second wall in the region of the upper end, and the respective biasing element is disposed in the region of the lower end.

4. The mold of claim 1, comprising a mounting bracket fast with each second wall; and wherein each support is mounted on the respective mounting bracket.

5. The mold of claim 4, wherein each biasing element bears against the respective support and the respective mounting bracket.

6. The mold of claim 1, wherein said first walls are longer than said second walls, and said casting passage is substantially rectangular in cross section.

7. The mold of claim 1, wherein at least one support comprises a roller.

8. The mold of claim 7, wherein said one support comprises a plurality of rollers.

9. The mold of claim 1, wherein at least one support comprises a cooling grid.

10. The mold of claim 1, wherein at least one support comprises a cooling plate.

11. The mold of claim 1, wherein at least one biasing element is resilient.

12. The mold of claim 1, wherein at least one biasing element comprises a spring.

13. The mold of claim 1, wherein at least one biasing element comprises an elastomer.

14. The mold of claim 1, wherein at least one biasing element comprises a bellows.

15. The mold of claim 1, comprising strand cooling means in the region of at least one support.

16. The mold of claim 15, wherein said cooling means comprises a spray nozzle.

17. The mold of claim 1, wherein said supports are movable relative to the respective second walls exclusively under the action of biasing elements which are devoid of an external power assist.

* * * * *